United States Patent [19]

Hasegawa

[11] 3,957,172

[45] May 18, 1976

[54] END PANEL FOR NESTED TAB SAFETY CLOSURE

[75] Inventor: Gary K. Hasegawa, Morton Grove, Ill.

[73] Assignee: Continental Can Company, Inc., New York, N.Y.

[22] Filed: July 14, 1975

[21] Appl. No.: 595,657

[52] U.S. Cl. ..... 220/269; 220/273; 220/277; 220/267

[51] Int. Cl.[2] ..... B65D 41/32

[58] Field of Search ..... 220/269, 270, 271, 272, 220/273, 277, 267

[56] References Cited

UNITED STATES PATENTS

| | | | |
|---|---|---|---|
| 3,235,123 | 2/1966 | Frankenberg | 220/267 |
| 3,880,318 | 4/1975 | Fraze | 220/273 |
| 3,894,651 | 7/1975 | Hannon | 220/269 |

*Primary Examiner*—George T. Hall

*Attorney, Agent, or Firm*—John J. Kowalik; Joseph E. Kerwin; William A. Dittmann

[57] ABSTRACT

An improved child-resistant self-opening end closure of the type wherein the tab is nested between end panel protrusions which obstruct access to the tab ring and prevent grasping and lifting of the tab to open the container. The end panel is formed with a recess beneath the nose portion of the tab which provides maximum clearance between the tab and the end panel, whereby depressing the nose portion of the tab causes the ring portion to tilt upwardly sufficiently to permit it to be grasped.

6 Claims, 4 Drawing Figures

END PANEL FOR NESTED TAB SAFETY CLOSURE

SUMMARY OF THE INVENTION

The present invention pertains to child-resistant safety closures, and more particularly, to child-resistant closures for self-opening cans.

Child-resistant self-opening end closures, of the type wherein the pull tab is nested between end panel protrusions which obstruct access to the tab ring, are known in the art (see co-pending Applications IMPROVED PULL TAB FOR NESTED TAB SAFETY CLOSURE — Docket No. J-1135 — and NESTED TAB SAFETY CLOSURE — Docket No. J-1068). End closures of this type may be subject to damage caused by accidental impact on the protruding, upturned nose portion of the tab. Such impacts could result in distortion of the tab and concomitant difficulties in opening the can, or in permanent displacement of the ring portion of the tab and resultant loss of the child-resistant feature of the closure. It is, therefore, the primary object of the present invention to provide an improved nested tab safety closure, wherein the nose portion of the pull tab is configured to minimize the possibility of damage resulting from accidental impact thereon.

It is a further object to provide an improved end panel that requires a minimum of modification to existing end panel tooling.

It is another object to provide an improved end panel which may be employed in conjunction with a simplified pull tab of the tab-nesting type.

It is yet another object to provide a child-resistant self-opening end closure that retains it child-resistant features despite mishandling.

BRIEF DESCRIPTION OF THE DRAWINGS

The various features and advantages of the end closure of this invention will be more apparent from the following detailed description when considered in connection with the accompanying drawing wherein.

DESCRIPTION OF THE PREFERRED EMBODIMENT

Figure 1:
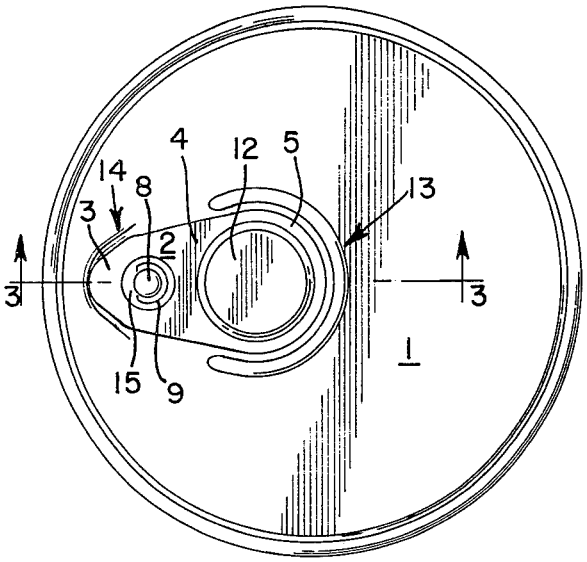
FIG. 1 is a top plane view of the security closure of the present invention, showing the tab in the nested position.
Figure 2:
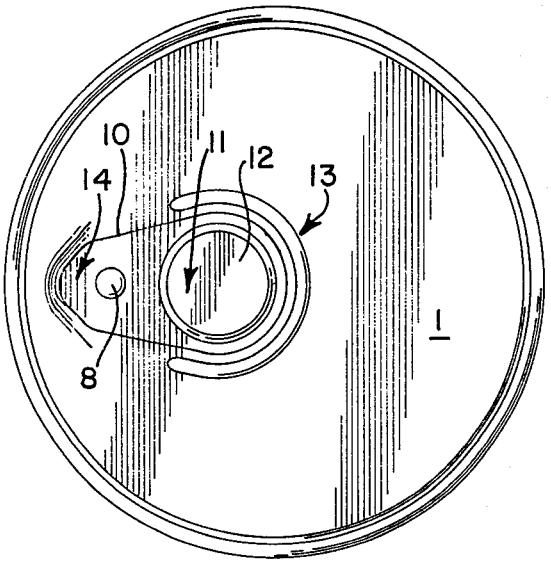
FIG. 2 is a top plane view similar to FIG. 1, showing the pull tab removed.

As shown in the drawings, the child-resistant closure of this invention comprises an end panel 1 and a pull tab 2.

The pull tab 2 comprises a nose portion 3, an intermediate portion 4 and a substantially circular finger ring portion 5, said portions being substantially coplanar. An integral piercing member or opener 6 is formed on the nose portion 4 and a recessed, substantially circular rivet well 7 is formed in the intermediate portion 4 and acts as a fulcrum accommodating tilting of the pull tab 2 relative to the end panel 1.

The rivet well 7 comprises a well wall **7*a* and a substantially flat, horizontal well base 7*b*, which is substantially parallel to the principal plane of the tab 2. The pull tab 2 is attached to the end panel 1 by an integrally formed rivet 8 which passes through a hole in the well base 7*b* and holds the base 7*b* flat against the end panel 1. A horseshoe-shaped slit 9 is formed in the well base 7*b* concentric with the rivet 8, opening toward the nose portion 3 of the tab 2. The slit 9 permits the pull tab 2 to be lifted without distortion of the end panel 1 in the area adjacent the rivet 8. The well wall 7*a* slopes outwardly from the well base 7b to provide sufficient clearance between the wall 7a and the head of the rivet 7 during lifting of the tab 2**.

The piercing member 6 comprises a panelward curl **6*a* on the distal edge of the nose portion 3 of the pull tab 2, and a vertical portion 6*b* extending panelwardly from the free edge of the curl 6*a***.

Two concentric curved protrusions 12 and 13, formed in the end panel 1, closely conform with and obstruct access to the finger ring portion 5 and prevent grasping and lifting of the pull tab 2. The inner protrusion 12, which is frustoconical in shape, is interior to the finger ring portion 5 and abuts the inner periphery of the portion 5 along its entire circumference. The outer protrusion 13 which comprises substantially flat, sloped sides **13*a* and a substantially flat, horizontal top 13, is exterior to the finger ring portion 5 and abuts the outer periphery of the portion 5. Both of the protrusions 12 and 13 extend beyond the principal plane of the tab 2 about the finger ring portion 5**.

The end panel 1 includes a score line 10 defining an opening flap 11. A tilt-enhancing recess 14 is formed in the end panel 1 beneath the nose portion 3 of the pull tab 2. The recess 14 comprises a sloped base **14*a* and a sidewall 14*b*, and is shaped to accommodate the nose portion 3. The slope of the base 14*a* is downward toward the periphery of the end panel 1. The score line 10 traverses the recess 14, with a segment 10*a* traversing the recess base 14*a* directly beneath the piercing member 6 on the nose portion 3**.

Figure 4:
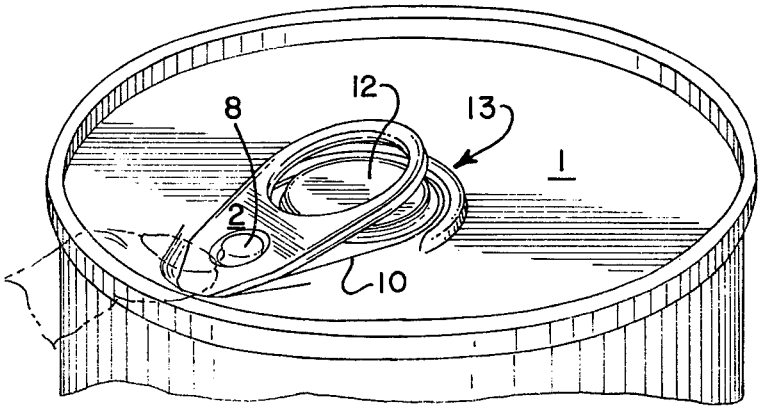
FIG. 4 is a perspective view showing the tab in the unnested position.

To open the closure, the nose portion 3 of the pull tab 2 is depressed into the recess 14, causing the tab 2 to tilt about the rivet well 7, thereby producing an upward displacement of the finger ring portion 5 and a flexure of the unslit area 15 of the well base **7*b* (FIG. 4). The ring 5** may now be grasped and the closure may be opened in the conventional manner.

Figure 3:
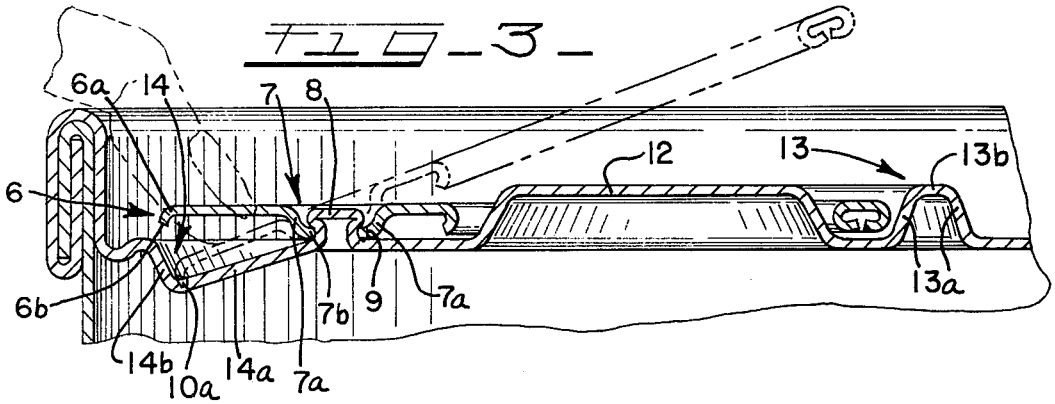
FIG. 3 is a diametrical cross-sectional view taken substantially along line 1—1 of FIG. 1.

If the nose portion 3 is released prior to grasping the ring 5, the counter-rotational force exerted on the tab 2 by the unslit area 15 causes the tab 2 to resume its nested position (FIGS. 1 and 3). It is, therefore, necessary that the operations required for opening the closure be performed in the proper sequence. This additional operation, which runs counter to a child's prior experience, and which must be coordinated with the conventional opening operations, renders removal of the closure beyond the capability of a young child.

I claim:

1. An improved child-resistant safety closure for a can or similar container comprising an end panel and a pull tab secured thereto and having a nose portion and a handle portion, said end panel having protrusions obstructing grasping of said handle portion, said pull tab being substantially planar and having a rivet well accommodating tilting said pull tab relative to said end panel, the improvement comprising: tilt enhancing recess means formed in said end panel beneath the tab whereby said pull tab may be tilted into the recess means in order that said handle portion may be grasped, thereby permitting opening of said container.

2. The invention as described in claim 1, wherein said recess means lies beneath said nose portion of said pull tab.

3. The invention as described in claim 2, wherein said end panel has a score defining an opening flap therein and said score traverses said recess means.

4. The invention as described in claim 3, wherein said recess means comprises a base and a sidewall and a portion of said score traverses said base.

5. The invention as described in claim 4, wherein a piercing member, for breaking said score, is formed on said nose portion of said pull tab and said portion of said score in said base lies beneath said piercing member.

6. The invention as described in claim 5, wherein said base slopes downwardly toward the periphery of said end panel.

* * * * *